US008525412B2

(12) United States Patent
Espiau et al.

(10) Patent No.: US 8,525,412 B2
(45) Date of Patent: Sep. 3, 2013

(54) METHOD AND SYSTEM FOR SELECTIVELY TUNING THE FREQUENCY OF A RESONATOR ASSEMBLY FOR A PLASMA LAMP

(75) Inventors: Frederick M. Espiau, Topanga, CA (US); Erik H. M. Lundin, Ventura, CA (US)

(73) Assignee: Topanga Technologies, Inc., Canoga Park, CA (US)

( * ) Notice: Subject to any disclaimer, the term of this patent is extended or adjusted under 35 U.S.C. 154(b) by 14 days.

(21) Appl. No.: 13/364,295

(22) Filed: Feb. 1, 2012
(Under 37 CFR 1.47)

(65) Prior Publication Data

US 2012/0286664 A1 Nov. 15, 2012

Related U.S. Application Data

(63) Continuation of application No. 12/624,384, filed on Nov. 23, 2009, now Pat. No. 8,179,047.

(60) Provisional application No. 61/117,485, filed on Nov. 24, 2008.

(51) Int. Cl.
*H01J 19/80* (2006.01)

(52) U.S. Cl.
USPC ..... 315/39; 315/111.01; 315/111.21; 315/39.51; 315/48

(58) Field of Classification Search
USPC ..... 315/111.01, 39
See application file for complete search history.

(56) References Cited

U.S. PATENT DOCUMENTS

| | | | | |
|---|---|---|---|---|
| 4,975,655 | A | 12/1990 | Dawson et al. | |
| 5,686,793 | A | 11/1997 | Turner et al. | |
| 5,777,857 | A | 7/1998 | Degelmann | |
| 5,838,108 | A | 11/1998 | Frank et al. | |
| 5,886,480 | A | 3/1999 | Penzenstadler et al. | |
| 5,923,122 | A | 7/1999 | Frank et al. | |
| 6,241,369 | B1 | 6/2001 | Mackiewicz | |
| 6,617,806 | B2 | 9/2003 | Kirkpatrick et al. | |
| 6,737,809 | B2 | 5/2004 | Espiau et al. | |
| 6,922,021 | B2 | 7/2005 | Espiau et al. | |
| 7,119,641 | B2 | 10/2006 | Petrov et al. | |
| 7,291,985 | B2 * | 11/2007 | Espiau et al. | 315/248 |
| 7,348,732 | B2 | 3/2008 | Espiau et al. | |
| 7,350,936 | B2 | 4/2008 | Ducharme et al. | |

(Continued)

OTHER PUBLICATIONS

Notice of Allowance for U.S. Appl. No. 12/624,384, mailed on Jan. 25, 2012, 6 pages.

(Continued)

*Primary Examiner* — Daniel Cavallari
*Assistant Examiner* — Srinivas Sathiraju
(74) *Attorney, Agent, or Firm* — Kilpatrick Townsend & Stockton LLP

(57) ABSTRACT

A plasma lamp system is described with the capability to tune the resonant frequency of the resonator of the plasma lamp system after the manufacturing process has been completed. The tuning method developed allows a simple low-cost approach to continuously tune the resonant frequency and set the desired frequency to an ISM (Industrial Scientific Medical) band or set the resonant frequency to optimize the performance of the system. The tuning ability of the resonator relaxes the tolerance required for the dimensions of the resonator reducing the manufacturing cost and improving the manufacturing yield of the plasma lamp.

20 Claims, 11 Drawing Sheets

(56) References Cited

U.S. PATENT DOCUMENTS

| | | | | |
|---|---|---|---|---|
| 7,358,678 | B2 | 4/2008 | Espiau et al. | |
| 7,362,054 | B2 * | 4/2008 | Espiau et al. | 315/39 |
| 7,362,055 | B2 | 4/2008 | Espiau et al. | |
| 7,362,056 | B2 | 4/2008 | Espiau et al. | |
| 7,372,209 | B2 | 5/2008 | Espiau et al. | |
| 7,391,158 | B2 | 6/2008 | Espiau et al. | |
| 8,110,988 | B2 * | 2/2012 | Espiau et al. | 315/39 |
| 8,159,136 | B2 * | 4/2012 | DeVincentis et al. | 315/39 |
| 2002/0135322 | A1 | 9/2002 | Hochi et al. | |
| 2005/0093481 | A1 | 5/2005 | Gao et al. | |
| 2006/0250090 | A9 | 11/2006 | Guthrie | |
| 2007/0236127 | A1 * | 10/2007 | DeVincentis et al. | 313/317 |
| 2008/0258627 | A1 | 10/2008 | Devincentis et al. | |

OTHER PUBLICATIONS

Ex Parte Quayle Action for U.S. Appl. No. 12/624,384, mailed on Dec. 7, 2011, 6 pages.

Notification Concerning Transmittal of International Preliminary Report on Patentability (Chapter 1 of the Patent Cooperation Treaty) of PCT Application No. PCT/US2009/065756, dated Jun. 3, 2011, 6 pages total.

International Search Report and Written Opinion of PCT Application No. PCT/US2009/065756, dated Jan. 26, 2010, 15 pages total.

* cited by examiner

METHOD AND SYSTEM FOR SELECTIVELY TUNING THE FREQUENCY OF A RESONATOR ASSEMBLY FOR A PLASMA LAMP

CROSS-REFERENCES TO RELATED APPLICATIONS

This application is a continuation application of U.S. Ser. No. 12/624,384, filed Nov. 23, 2009, now U.S. Pat. No. 8,179,047, which claims priority to U.S. Provisional Patent Application No. 61/117,485, filed Nov. 24, 2008, both of which is commonly assigned, and hereby incorporated by reference herein.

BACKGROUND OF THE INVENTION

The present invention relates generally to lighting techniques. In particular, the present invention provides a method and device using a plasma lighting device having one of a plurality of base configurations. More particularly, the present invention provides a method and resulting system for adjusting a frequency for a resonator assembly of a plasma lighting device. Merely by way of example, such configurations can include at least warehouse lamps, stadium lamps, lamps in small and large buildings, street lamps, parking lot lamps, and other applications that can be retrofitted, and the like.

From the early days, human beings have used a variety of techniques for lighting. Early humans relied on fire to light caves during hours of darkness. Fire often consumed wood for fuel. Wood fuel was soon replaced by candles, which were derived from oils and fats. Candles were then replaced, at least in part by lamps. Certain lamps were fueled by oil or other sources of energy. Gas lamps were popular and still remain important for outdoor activities such as camping. In the late 1800s, Thomas Edison invented a reliable incandescent lamp, which uses a tungsten filament within a bulb, coupled to a pair of electrodes. Many conventional buildings and homes still use the incandescent lamp, commonly called the Edison bulb. Although highly successful, the Edison bulb consumes too much energy and is generally inefficient.

Fluorescent lighting replaced incandescent lamps for certain applications. Fluorescent lamps generally consist of a tube containing a gaseous material, which is coupled to a pair of electrodes. The electrodes are coupled to an electronic ballast, which helps ignite the discharge from the fluorescent lighting. Conventional building structures often use fluorescent lighting, rather than the incandescent counterpart. Fluorescent lighting is much more efficient than incandescent lighting, but often has a higher initial cost.

Shuji Nakamura pioneered the efficient blue light emitting diode. The blue light emitting diode forms a basis for the white solid state light, which is often a blue light emitting diode coated with a yellow phosphor material. Blue light excites the phosphor material to emit white lighting. The blue light emitting diode has revolutionized the lighting industry to replace traditional lighting for homes, buildings, and other structures.

Another form of lighting is commonly called the electrode-less lamp, which can be used to discharge light for high intensity applications. Frederick M. Espiau was one of the pioneers that developed an improved electrode-less lamp. Such electrode-less lamp relied solely upon a solid ceramic resonator structure fixed against a fill enclosed in a bulb. The bulb was coupled to the resonator structure via RF (radio frequency) feeds, which transferred power to the fill to cause it to discharge high intensity lighting. Another example of a conventional technique for improving the electrode-less lamp is described in "Frequency Tunable Resonant Cavity For Use with An Electrodeless Plasma Lamp," in the name of Marc DeVincentis and Sandeep Mudunuri listed as U.S. Publication No. 2008/0258627A1, which is limited to tuning a solid dielectric resonator that has drawbacks. Although somewhat successful, the electrode-less lamp still had many limitations. As an example, electrode-less lamps have not been successfully deployed on a wide scale.

From the above, it is seen that improved techniques for lighting are highly desired.

BRIEF SUMMARY OF THE INVENTION

According to the present invention, techniques for lighting are provided. In particular, the present invention provides a method and device using a plasma lighting device having one of a plurality of base configurations. More particularly, the present invention provides a method and resulting system for adjusting a frequency for a resonator assembly for a plasma lamp, which can be used for a variety of applications. The ability to adjust (tune) the frequency of the resonator assembly significantly improves manufacturing yield, simplifies manufacturing by reducing the tolerances of the dimensions of the resonator, and improves lamp performance. In addition one can compensate for any changes in the resonant frequency of the resonator caused by temperature fluctuations or aging. The plasma lamps have applications such as stadiums, security, parking lots, military and defense, streets, large and small buildings, vehicle headlamps, aircraft landing, bridges, warehouses, UV water treatment, agriculture, architectural lighting, stage lighting, medical illumination, microscopes, projectors and displays, any combination of these, and the like.

A typical electrode-less plasma lamp consists of a resonator to efficiently couple RF energy to a gas-fill vessel (bulb) that has no electrodes inside the bulb. In order to couple RF energy efficiently to the bulb the frequency of the RF source has to closely match the resonant frequency of the resonator. Furthermore, in some applications it is highly desirable to operate the plasma lamp system at a specific frequency to be within the ISM (Industrial Scientific Medical) band, which is typically very narrow. The resonant frequency of the resonator, among other things, depends on the dimensions of the lamp body and dielectric constant of the material used inside the lamp body. During the manufacturing process, variations in the dimensions of the mechanical components of the resonator due to manufacturing tolerances can result in variations of the resonant frequency of the resonators. As a result, some of the manufactured lamps can have resonant frequencies that do not fall within the acceptable range, thereby resulting in low manufacturing yields and poor performance. The ability to tune the frequency of the manufactured resonators allows lowering manufacturing tolerances to reduce cost while maintaining high yield. Also the ability to tune the frequency also helps to optimize the overall lamp system performance and tuning the system to operate within the ISM band.

In one aspect, the plasma electrodeless lamp comprises a substantially hollow metallic body, closely receiving two coupling elements, the first coupling element (input coupling element) and the second coupling element (output coupling element). One end of the input coupling element is connected to the output of an RF power amplifier and the other end of the input coupling element is conductively connected (e.g., grounded) to metallic lamp body at its top surface. One end of the output coupling element is conductively connected to the metallic lamp body at the bottom surface and the other end of the output coupling element closely receives a gas-fill vessel (bulb) which forms a radiant plasma when excited by RF energy. The gas-fill vessel has a transparent or translucent body, an inner surface and an outer surface, a cavity formed within the inner surface. The gas filled vessel is filled with an inert gas such as argon and a light emitter such as mercury, sodium, dysprosium, sulfur or a metal halide salt such as indium bromide, scandium bromide, Thallium Iodide, Holmium Bromide, Cesium Iodide or other similar materials (or it can simultaneously contain multiple light emitters). Electromagnetic energy is coupled between the input coupling element and the output coupling element; this coupling is both inductive and capacitive in nature. The lamp body also has a frequency tuning element. The frequency tuning element consists of a variable length tuning stub and a fixed length tuning stub. The variable length tuning stub has screw threads covering at least part of the length of the tuning element. The variable length tuning stub is threaded through the bottom of the lamp body and extends into the lamp body. The fixed length tuning element is connected at one end to the top surface of the lamp body and it is extended into the lamp body from the top directly across the variable length tuning element. The fixed tuning element is hollow inside and it is slightly larger in diameter than the variable length tuning element. The variable length tuning element extends into the fixed tuning element and the overlap between the two tuning element forms a capacitor. As the variable tuning element is rotated it can be extended further or less into the fixed tuning element changing the value of the capacitor. By the changing the value of this capacitor the resonant frequency of the resonator can be changed.

In an alternative specific embodiment, a low RF loss dielectric material such as Teflon or alumina covers one end of the variable tuning element that extends into the fixed tuning element. The dielectric material increases the overall capacitance between the tuning elements and helps in centering the variable tuning element within the fixed tuning element.

In an alternative specific embodiment, a dielectric ring is used at the end of the variable length tuning element to help in centering it within the fixed tuning element.

In a preferred embodiment, the present invention provides a method and configurations with an arrangement that provides for improved manufacturability as well as design flexibility. In a specific embodiment, the present method and resulting structure are relatively simple and cost effective to manufacture for commercial applications. In a preferred embodiment, the present lamp includes a tuning device that allows for more efficient manufacturing, lamp setup, and maintenance. Depending upon the embodiment, one or more of these benefits may be achieved. These and other benefits may be described throughout the present specification and more particularly below.

The present invention achieves these benefits and others in the context of known process technology. However, a further understanding of the nature and advantages of the present invention may be realized by reference to the latter portions of the specification and attached drawings.

DETAILED DESCRIPTION OF THE INVENTION

Figure 1:
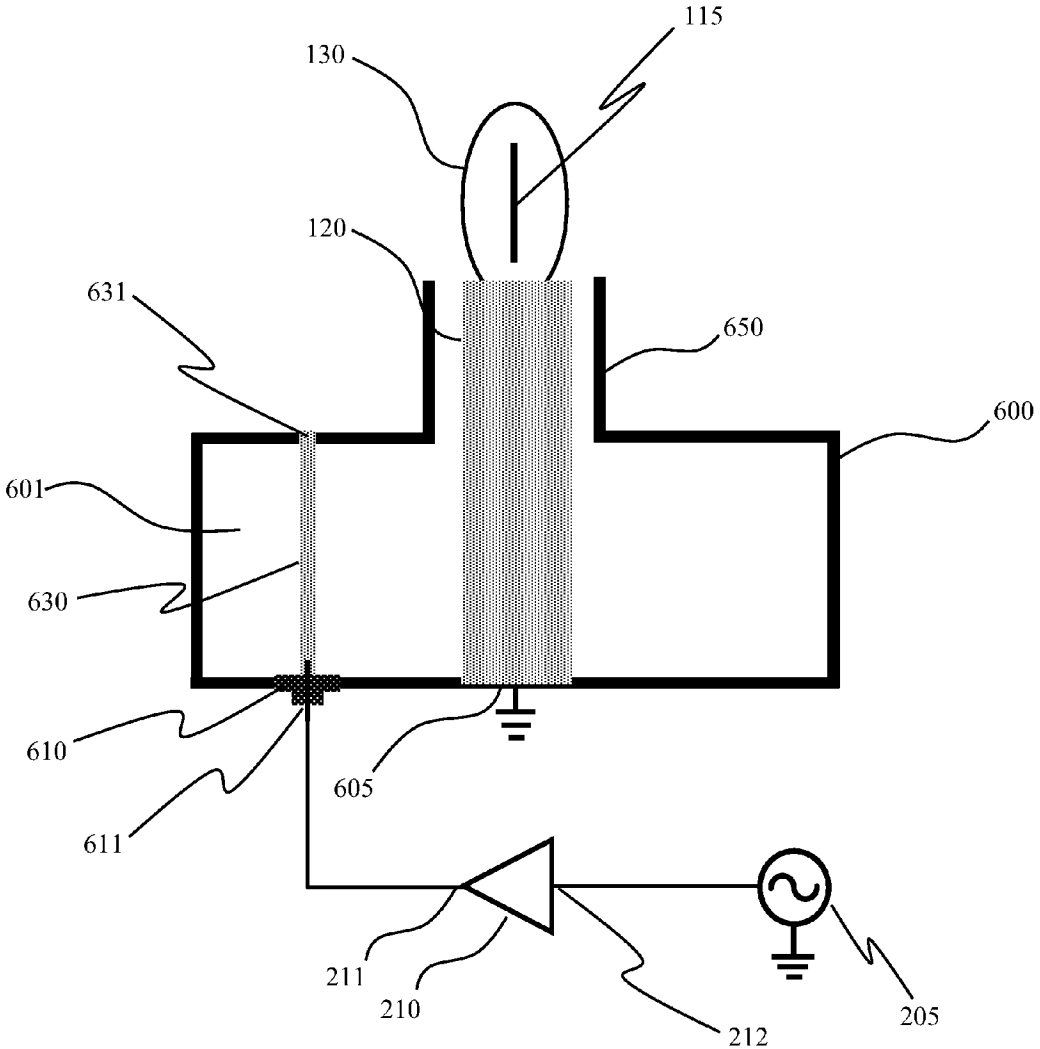
FIG. 1 is a simplified cross-sectional diagram of a plasma lamp device illustrating an air resonator without the frequency tuning element.

According to the present invention, techniques for lighting are provided. In particular, the present invention provides a method and device using a plasma lighting device having one of a plurality of base configurations, e.g., compact air resonator, air resonator, air resonator including a dielectric insert or sleeve, dielectric resonator. More particularly, the present invention provides a method and resulting system for adjusting a frequency for a resonator assembly for a plasma lamp, which can be used for a variety of applications. Merely by way of example, such plasma lamps can be applied to applications such as stadiums, security, parking lots, military and defense, streets, large and small buildings, vehicle headlamps, aircraft landing, bridges, warehouses, UV water treatment, agriculture, architectural lighting, stage lighting, medical illumination, microscopes, projectors and displays, any combination of these, and the like.

The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the Claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

FIG. 1 illustrates a simplified cross-sectional diagram of a plasma lamp device using an air resonator without the frequency tuning element. The plasma lamp device employs a substantially hollow metallic lamp body 600, enclosing the unfilled space 601. Metallic lamp body 600 constitutes an electrical ground, as indicated. It has been found through both electromagnetic modeling and experimentation that overall lamp operation is not sensitive to either the outer shape of the body 600, or the shape of the enclosed space 601. For example, body 600 may be rectilinear, while hollow space 601 may be cylindrical. Of course, there can be other variations, modifications, and alternatives.

Lamp body 600 includes a hollow protruding feature 650. The output coupling element 120, which is a solid metallic cylindrical post, or a dielectric material coated with highly electrically conductive metallic layer, or other suitable member, is closely received within protruding feature 650 of the lamp body. The height of the protruding feature 650, as well as the height of the output coupling element 120 and the gap between the two, is part of the design variables that serve to tune the optimal operating frequency of the lamp. Those skilled in the art will recognize that the cross section may be of many shapes, but ease of manufacturing would make a circular cross section preferable, while avoidance of high electromagnetic field concentrations that may lead to arcing would make cross sections with sharp features undesirable. One end of the output coupling element 120 is grounded to the body 600 as depicted in FIG. 1 at point 605. The top of output coupling element 120 closely receives and is in intimate contact with gas-fill vessel 130, which when excited by the electromagnetic field near the output coupling element 120 forms a radiant plasma filament 115. The gas-fill vessel is a bulb made from materials such as quartz or transparent/translucent alumina and contains an inert gas such as Argon as well as a light emitter consisting of materials such as Mercury, Sodium, Dysprosium, Sulfur or a metal halide salt such as Indium Bromide, Scandium Bromide, Thallium Iodide, Holmium Bromide, Cesium Iodide or other similar materials (or it can simultaneously contain multiple light emitters). The output coupling element couples the RF energy to the gas-fill vessel ionizing the inert gas and vaporizing the light emitter resulting in intense light emission from the bulb. A slight depression corresponding to the shape of bulb 130 may exist at the top of output coupling element 120 to positively receive the former; a thin layer of high temperature dielectric material such as alumina may be configured with an adhesive to enhance the mechanical interface. In certain embodiments, the dielectric material may also act as a diffusion barrier between the bulb and the metal output coupling element.

The lamp body 600 receives the coaxial type connector 610 at a bottom opening such that the outer surface of the connector is electrically contacting the lamp body 600. Examples of connector types are SMA or N, although may others are possible. The insulated center conductor 611 of the coaxial type connector 610 is connected to input coupling element 630. The other end of the center conductor 611 is connected to the output 211 of the RF amplifier 210. An RF oscillator 205 is connected to the input 212 of the RF amplifier 210. The input coupling element 630 is electrically isolated from the lamp body 600 near the connector 610, but is in direct electrical contact with the lamp body 600 on the opposite face at point 631. It is to be appreciated that this so-called grounded coupling element permits efficient electromagnetic coupling to the center post 120. The coupling between the input coupling element and the output coupling element depends on the length of the input coupling element, the separation between the coupling elements, and the diameter of the coupling elements, and possibly other factors according to one or more embodiments.

Electromagnetic energy is coupled strongly from the input coupling element 630 to the output coupling element 120, and in turn to the gas fill within bulb 130. The impedance matching between the source of electromagnetic energy and the center post/bulb system (120/130) is mediated by the separation between the input coupling element 630 and the output coupling element 120 and their dimensions. This offers an effective adjustment mechanism that imposes no additional manufacturing burden.

Figure 2A:
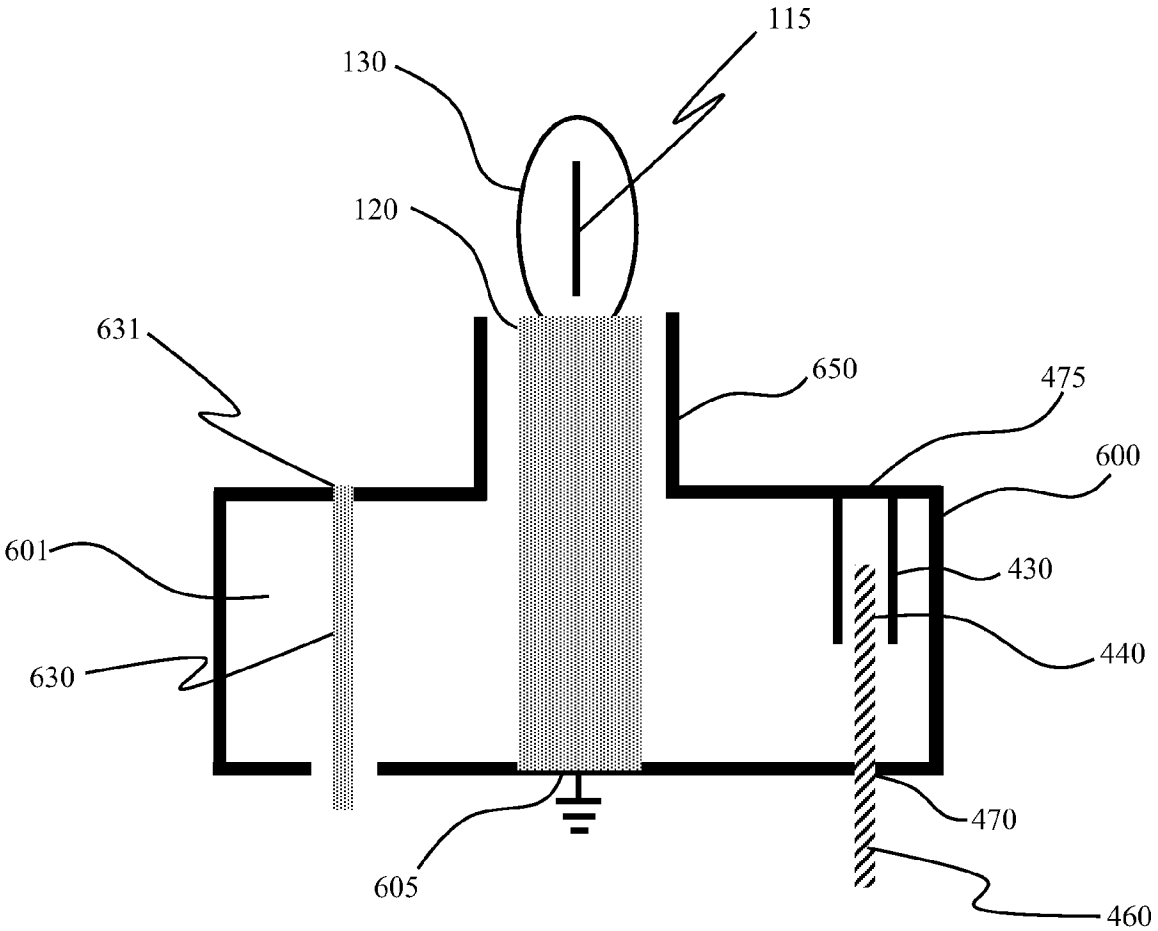
FIG. 2A is a simplified cross-sectional diagram of a plasma lamp device similar to the air resonator in FIG. 1 illustrating the frequency tuning element according to an embodiment of the present invention.

FIG. 2A is a simplified cross-sectional diagram of a plasma lamp device according to embodiments of the present invention. This diagram is merely an example, which should not unduly limit the scope of claims. One difference between the devices shown in FIG. 1 and FIG. 2A is that the plasma lamp in FIG. 2A comprises a frequency tuning element that is added to the resonator. The RF source and the connection to the input coupling element 630 are not shown in this Figure but are still part of the system. The tuning element includes a variable length tuning stub 460 made from a metal with screw threads covering at least part of the length of the tuning stub. The tuning stub is threaded into the bottom of the resonator housing 600 making electrical connection at 470 and protruding into the resonator body 440. One end of a fixed tuning stub 430, also made from a metal, is connected at the top 475 of the resonator housing directly opposite the variable tuning stub. The fixed tuning stub has a larger inner diameter than the variable tuning stub and is hollow inside such that the variable tuning stub can protrude into it without touching the walls of the fixed tuning stub. The overlap between the variable tuning stub and fixed tuning stub forms a capacitor. Depending on the application, the capacitance of this capacitor can be changed by screwing the variable tuning stub either more or less into the fixed tuning stub changing the total area of overlap between the two stubs and as a result the value of the capacitor. The two tuning stubs form an LC tuning circuit that can be used to tune the resonant frequency of the resonator after the resonator has been manufactured. Of course, there can be other variations, modifications, and alternatives.

Figure 2B:
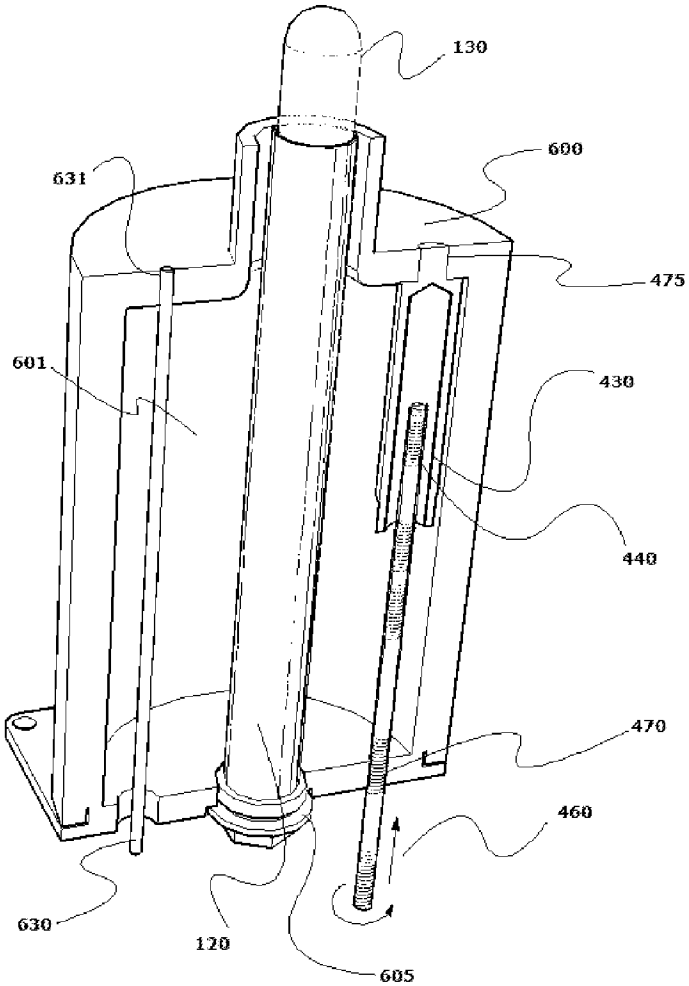
FIG. 2B is a perspective view of the plasma lamp device of FIG. 2A illustrating the frequency tuning element according to an embodiment of the present invention.

FIG. 2B is a perspective view of the plasma lamp device shown in FIG. 2A. The Figure shows the plasma lamp device with part of the resonator housing 600 removed. The variable tuning stub 460 is at least partially covered with screw threads and is threaded into the bottom 470 of the resonator housing 600, making electrical contact with resonator body. The fixed tuning stub 430 is hollow inside and one of its ends is connected to the top 475 of the resonator housing 600. The fixed tuning stub 430 has a larger diameter than the variable tuning stub 460 and the variable tuning stub protrudes into it without touching the walls of the fixed tuning stub 430. As the variable tuning stub 460 is rotated the overlap area 440 with the fixed tuning stub 430 changes resulting in change in the capacitance of the tuning element. This change in capacitance results in change in the resonant frequency of the resonator.

Figure 3A:
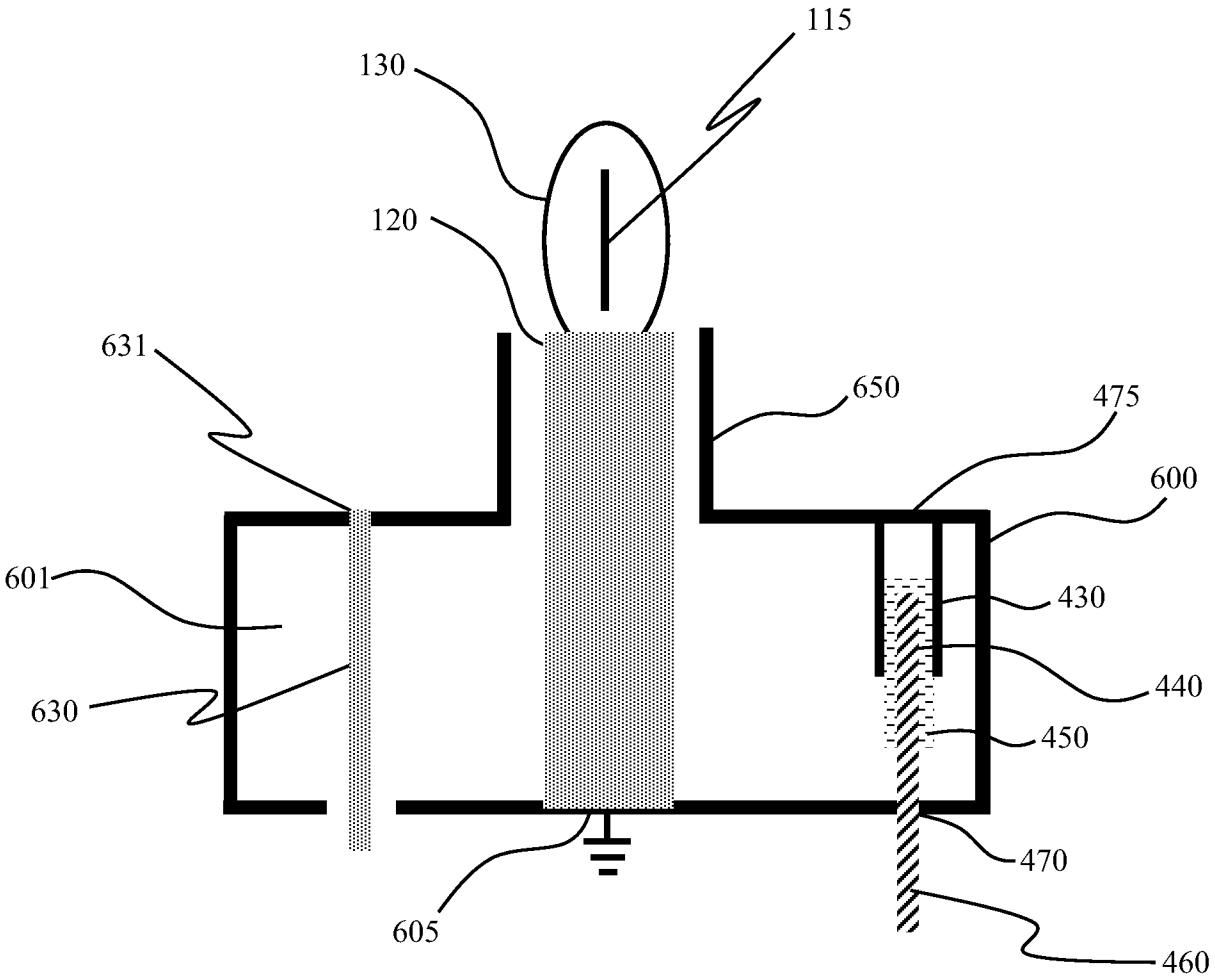
FIG. 3A is a simplified cross-sectional diagram of a plasma lamp device similar to the air resonator in FIG. 1 illustrating an alternative frequency tuning element according to an embodiment of the present invention.

FIG. 3A is a simplified cross-sectional diagram of a plasma lamp device with a frequency tuning element similar to the one shown in FIG. 2A except an alternative frequency tuning element is used in this resonator. The tuning element in FIG. 3A has a dielectric material 450 surrounding the end of the variable tuning element 460. This dielectric material, which can be made from materials such as Teflon or alumina, increases the capacitance of the tuning element but it also serves to center the variable tuning element 460 inside the fixed tuning element 430.

Figure 3B:
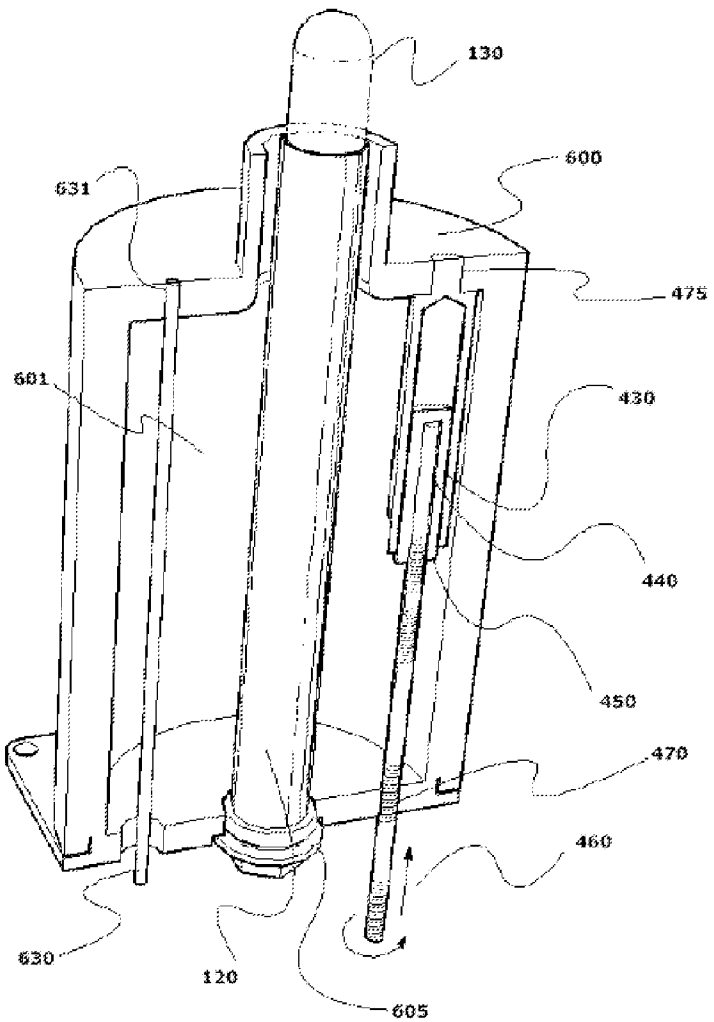
FIG. 3B is a perspective view of the plasma lamp device of FIG. 3A illustrating an alternative frequency tuning element according to an embodiment of the present invention.

FIG. 3B is a perspective view of the plasma lamp device shown in FIG. 3A. It is similar to FIG. 2B except for the addition of the dielectric material 450 around the end of the variable tuning element 460.

Figure 4A:
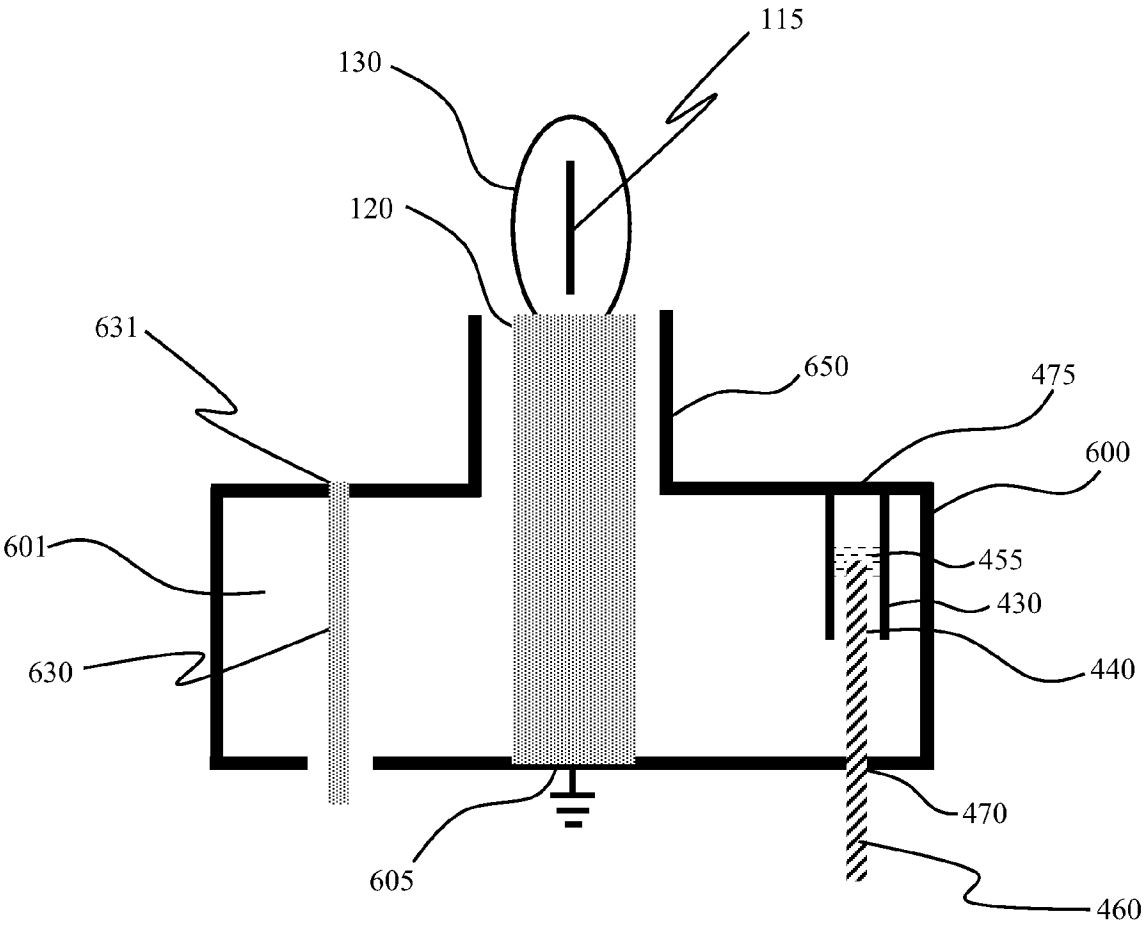
FIG. 4A is a simplified cross-sectional diagram of a plasma lamp device similar to the air resonator in FIG. 1 illustrating an alternative frequency tuning element according to an embodiment of the present invention.

FIG. 4A is a simplified cross-sectional diagram of a plasma lamp device with a frequency tuning element similar to the one shown in FIG. 2A except an alternative frequency tuning element is used in this resonator. The tuning element in FIG. 4A has a dielectric ring 455 at the end of the variable tuning element 460. This dielectric material, which can be made from materials such as Teflon or alumina, primarily serves to center the variable tuning element 460 inside the fixed tuning element 430.

Figure 4B:
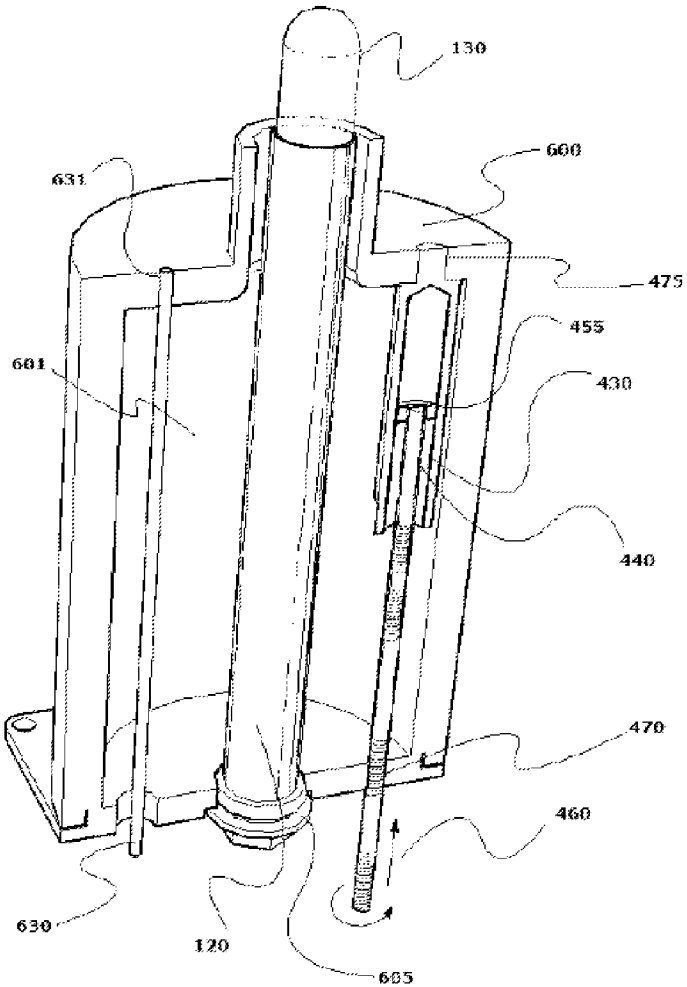
FIG. 4B is a perspective view of the plasma lamp device of FIG. 4A illustrating an alternative frequency tuning element according to an embodiment of the present invention.

FIG. 4B is a perspective view of the plasma lamp device shown in FIG. 4A. It is similar to FIG. 2B except for using a dielectric ring 455 around the end of the variable tuning element 460 to center the variable tuning element inside the fixed tuning element 430.

Figure 5:
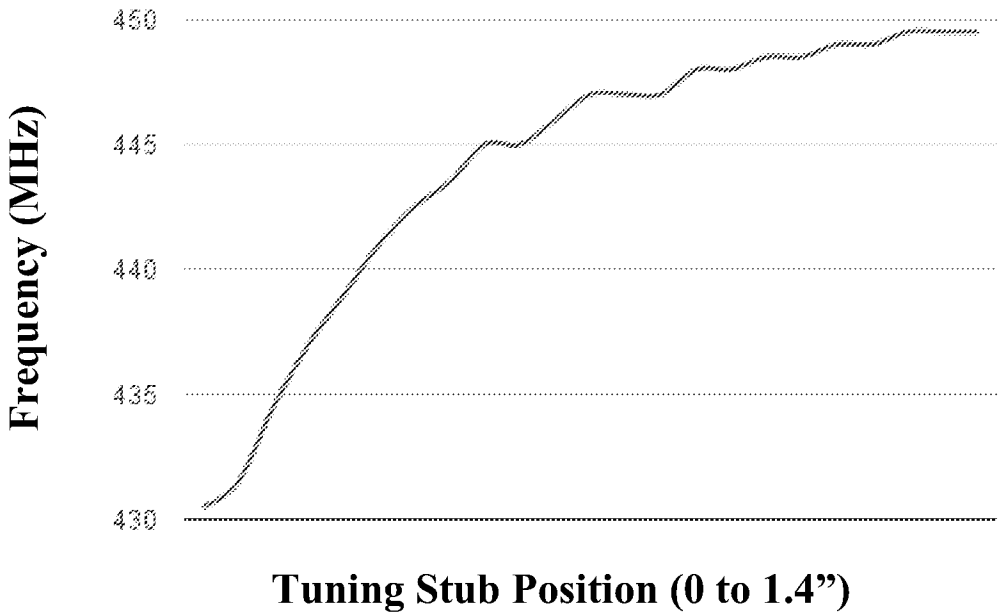
FIG. 5 is a simplified diagram illustrating the change in resonant frequency of the air resonator versus position of the tuning stub.

FIG. 5 illustrates the change in resonant frequency of the resonator from approximately 430 MHz to approximately 450 MHz as the variable tuning element length inside the fixed tuning element is changed from position 0" to position 1.4".

Figure 6:
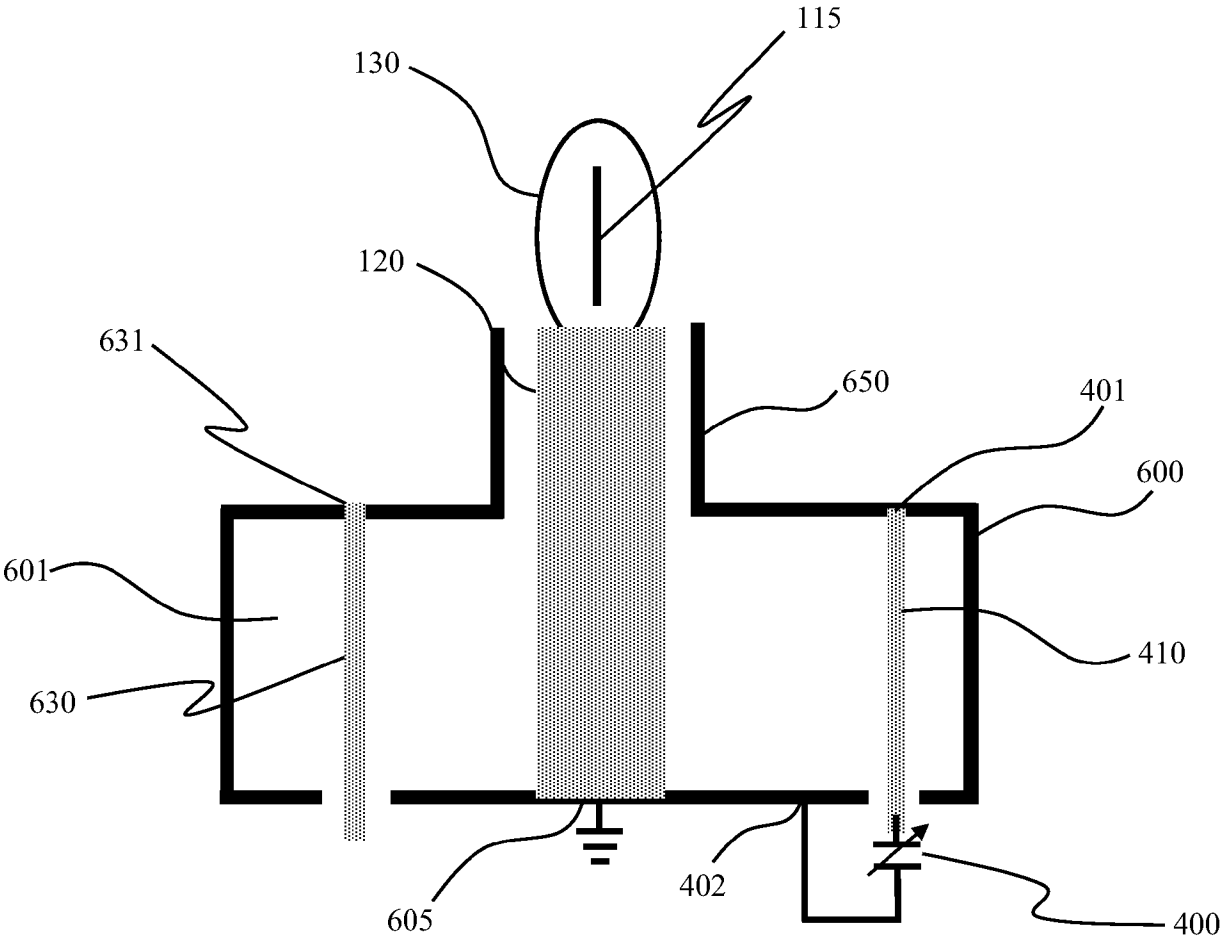
FIG. 6 is a simplified cross-sectional diagram illustrating a plasma lamp device similar to the air resonator in FIG. 1 illustrating an alternative frequency tuning element according to an embodiment of the present invention.

FIG. 6 is a simplified cross-sectional diagram of a plasma lamp device with a frequency tuning element similar to the one shown in FIG. 2A except an alternative frequency tuning element is used in this resonator. The tuning element consists of a fixed tuning element 410 which is connected at one end to the top of the resonator housing 600 at 401 and the other end is connected to one side of a lumped variable capacitor 400. The other side of the lumped variable capacitor is connected to the lamp body 600 at 402. By changing the value of this capacitor (typically by turning a screw on the capacitor) the resonant frequency of the resonator can be changed. This diagram is merely an illustration, which should not limit the scope of the claims herein. One of ordinary skill in the art would recognize other variations, modifications, and alternatives.

Figure 7:
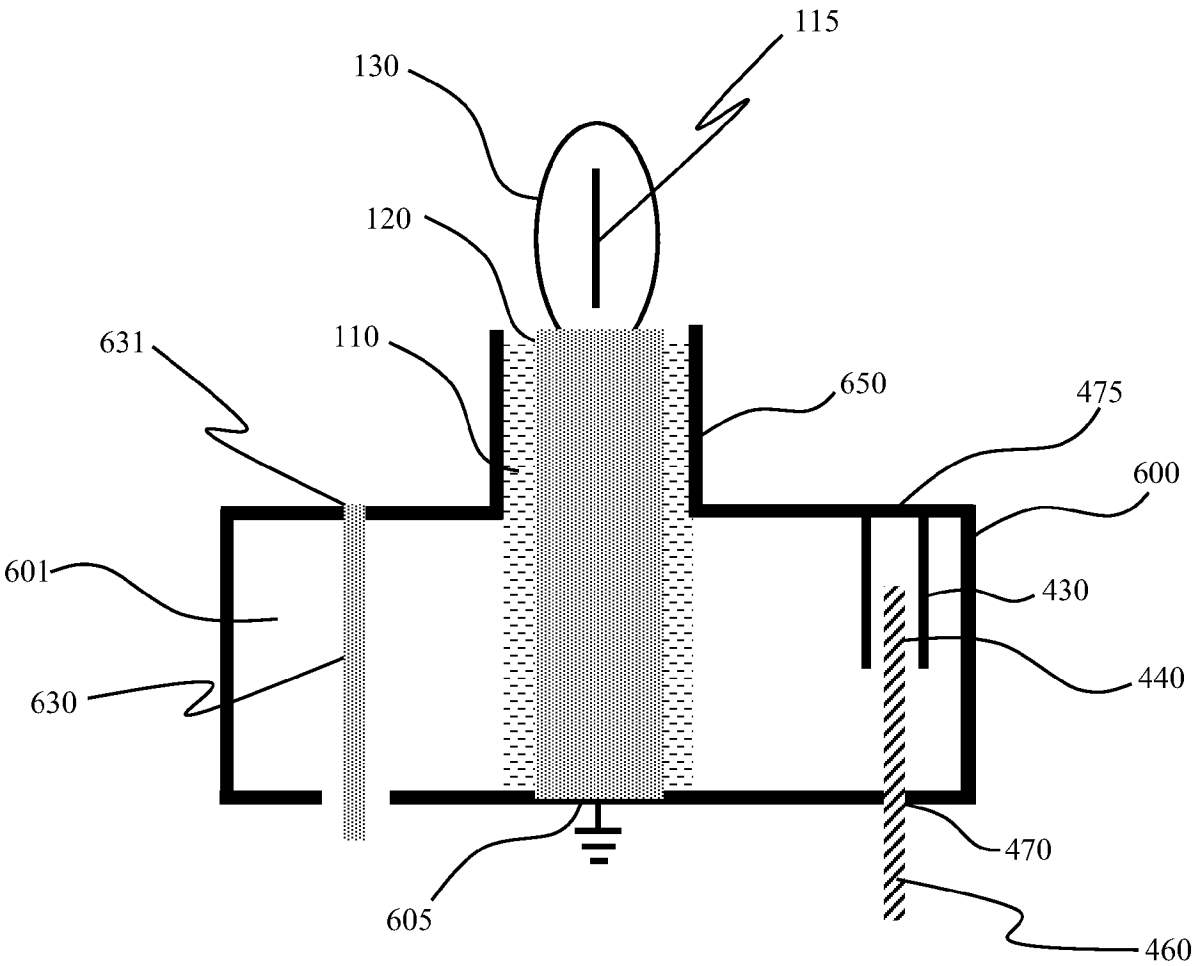
FIG. 7 is a simplified cross-sectional diagram illustrating a plasma lamp device similar to FIG. 2A with a dielectric sleeve around the center post according to an embodiment of the present invention.

FIG. 7 is a simplified cross-sectional diagram illustrating a plasma lamp device similar to FIG. 2A with a dielectric sleeve 110 around the output coupling element 120. The dielectric material can be made from a low RF loss material such as quartz or alumina. The addition of the dielectric sleeve will decrease the resonant frequency of the resonator.

Figure 8:
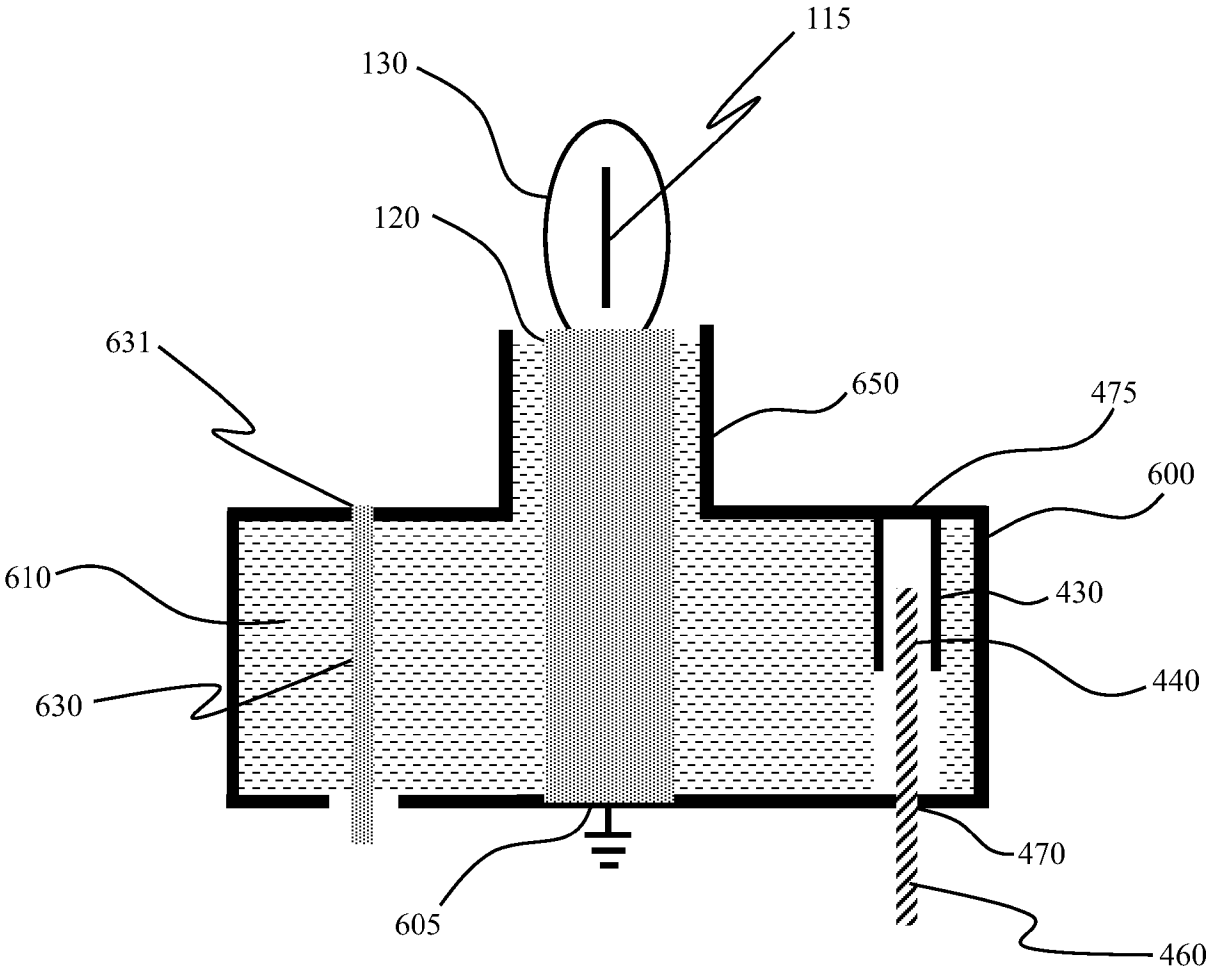
FIG. 8 is a simplified cross-sectional diagram illustrating a plasma lamp device similar to FIG. 2A but the resonator body is made from solid dielectric material instead of air according to an embodiment of the present invention.

FIG. 8 is a simplified cross-sectional diagram illustrating a plasma lamp device similar to FIG. 2A but the resonator body 600 is made from a solid dielectric material 610 or it can be filled with a low RF loss material instead of air. For example, by using a dielectric material with a dielectric constant greater than 1, it is possible to lower the resonant frequency of the resonator.

While the above is a full description of the specific embodiments, various modifications, alternative constructions and equivalents may be used. As an example, the tuning device can be a dielectric sleeve with one or more spatial configurations, which may be moved relative to the support member. Alternatively, the tuning device can also be inserted within the air resonator structure, which causes it to change in volume and lead to changes in resonating frequencies. In other embodiments, the tuning device can be a combination of these, among other elements. Therefore, the above description and illustrations should not be taken as limiting the scope of the present invention which is defined by the appended claims.

What is claimed is:

1. A plasma lamp apparatus comprising:

a housing having a spatial volume defined within the housing, the spatial volume having an inner region and an outer region;

a support region coupled to the inner region of the spatial volume;

a support body having an outer surface region disposed within or partially disposed within the support region, the support body having a support length, a support first end, and a support second end, the second end being coupled to one or more portions of the housing;

a gas-filled vessel coupled to the support first end of the support body, the gas filled vessel having a transparent or translucent body, an inner surface and an outer surface, a cavity formed within the inner surface;

an RF (radio frequency) source operably coupled to the gas-filled vessel;

a tuning device configured within the inner region of the housing, the tuning device having an upper portion and a lower portion, the tuning device being a first electrode element of a capacitor;

a second electrode element spatially disposed along a length of the first electrode element, the second capacitor electrode element protruding from a portion of the housing;

a capacitor dielectric material configured between the first electrode element and the second electrode element; and an adjustment device coupled to the lower portion of the of the tuning device and configured to cause movement of the first electrode element to the second electrode element to increase a size of the capacitor and capacitance value from a first capacitance value to a second capacitance value based on a predetermined distance to capacitance ratio.

2. The lamp of claim 1 wherein the support region is configured in an annular manner.

3. The lamp of claim 1 wherein the adjustment device comprises a plurality of threads integrally coupled to a portion of the housing support region to cause the tuning device to move up and down within the inner region and respectively increase and decrease the size of the capacitor.

4. The lamp of claim 1 wherein the first electrode element comprises a dielectric material formed thereon as a capacitor dielectric.

5. The lamp of claim 1 wherein the resonating frequency ranges from about 10 MHz to about 10 GHz.

6. The lamp of claim 1 wherein the resonating frequency is less than about 250 MHz.

7. The lamp of claim 1 wherein the second electrode element is configured as a tube structure to house the first capacitor element.

8. The lamp of claim 1 wherein the second electrode element is configured as a tube structure to form a cylindrical capacitor structure, the cylindrical capacitor structure comprising the first electrode element, the second electrode element, and a dielectric material.

9. The lamp of claim 1 wherein the first electrode element is made of a metal, the metal being one of aluminum, steel, copper, zinc, brass, silver coated metal, or silver coated dielectric.

10. The lamp of claim 1 wherein the capacitor dielectric material is made of a Teflon™ or alumina.

11. The lamp of claim 1 wherein the capacitor dielectric material is configured as a centering device coupling the first electrode element to the second electrode element.

12. The lamp of claim 1 wherein the distance to capacitance ratio being substantially linear within a predetermined range.

13. The lamp of claim 1 wherein the support body is configured to draw a portion of thermal energy from the gas filled vessel to maintain the gas filled vessel to a temperature of less than about 900 Degrees Celsius for quartz gas filled vessel and less than about 1400 Degrees Celsius for translucent alumina gas filled vessel to substantially maintain the gas filled vessel free from deformation.

14. The lamp of claim 1 wherein the support body comprises a boundary region coupled to the gas filled vessel, the boundary region being configured to block a portion of an electromagnetic field associated with the RF power source from at least a portion of the gas filled vessel.

15. The lamp of claim 14 wherein the portion of the gas filled vessel is an optically exposed region.

16. A method for selecting a resonant frequency from a plurality of frequencies from a plasma lamp apparatus comprising a gas fill bulb coupled to a housing and a resonator source, the method comprising adjusting an adjustment device to move a first electrode element relative to a second electrode element within an inner region of the housing to cause an increase or decrease in a capacitor region to tune a frequency to a selected frequency from a plurality of frequencies.

17. A method of selecting a resonant frequency from a plurality of frequencies for a plasma lamp device, the method comprising:

providing a plasma lamp apparatus, comprising:

a housing having a spatial volume defined within the housing, the spatial volume having an inner region and an outer region;

a support region coupled to the inner region of the spatial volume;

a support body having an outer surface region disposed within or partially disposed within the support region, the support body having a support length, a support first end, and a support second end, the second end being coupled to one or more portions of the housing;

a gas-filled vessel coupled to the support first end of the support body, the gas filled vessel having a transparent or translucent body, an inner surface and an outer surface, a cavity formed within the inner surface;

an RF (radio frequency) source operably coupled to the gas-filled vessel;

a tuning device configured within the inner region of the housing, the tuning device having an upper portion and a lower portion, the tuning device being a first electrode element of a capacitor;

a second electrode element spatially disposed along a length of the first electrode element, the second capacitor electrode element protruding from a portion of the housing;

a capacitor dielectric material configured between the first electrode element and the second electrode element; and an adjustment device coupled to the lower portion of the of the tuning device and configured to cause movement of the first electrode element to the second electrode element to increase a size of the capacitor and capacitance value from a first capacitance value to a second capacitance value based on a predetermined distance to capacitance ratio; and causing movement of the adjustment device to select a resonant frequency from a plurality of frequencies.

18. The method of claim 16 wherein the plasma lamp apparatus comprises a visual indicator, the visual indicator being configured to provide a visual signal indicating that the resonant frequency is reached.

19. The method of claim 16 wherein the plasma lamp apparatus comprises an audio indicator, the audio indicator being configured to provide an audio signal indicating that the resonant frequency is reached.

20. The method of claim 16 wherein the distance to capacitance ratio being substantially linear within a predetermined range.

* * * * *